US007399196B2

(12) United States Patent
Chang

(10) Patent No.: US 7,399,196 B2
(45) Date of Patent: Jul. 15, 2008

(54) INTERFACE CARD FIXING MEMBER

(75) Inventor: Lin-Wei Chang, Tapei (TW)

(73) Assignee: Inventec Corporation (TW)

( * ) Notice: Subject to any disclaimer, the term of this patent is extended or adjusted under 35 U.S.C. 154(b) by 0 days.

(21) Appl. No.: 11/818,266

(22) Filed: Jun. 13, 2007

(65) Prior Publication Data

US 2008/0132107 A1 Jun. 5, 2008

(30) Foreign Application Priority Data

Dec. 4, 2006 (TW) ..... 95144922 A

(51) Int. Cl.
*H01R 13/64* (2006.01)

(52) U.S. Cl. ..... 439/377; 361/756; 361/801

(58) Field of Classification Search ..... 361/756, 361/759, 801–802; 439/377
See application file for complete search history.

(56) References Cited

U.S. PATENT DOCUMENTS 6,700,791 B1 * 3/2004 Zappacosta ..... 361/759

6,738,261 B2 * 5/2004 Vier et al. ..... 361/740

FOREIGN PATENT DOCUMENTS

TW M276240 9/1994

* cited by examiner

*Primary Examiner*—Truc T Nguyen
(74) *Attorney, Agent, or Firm*—Peter F. Corless; Steven M. Jensen; Edwards Angell Plamer & Dodge LLP

(57) ABSTRACT

An interface card fixing member is disclosed according to the present invention. The interface card fixing member is applicable to a fixing bracket of an electrical device, for fixing an interface card. The interface card fixing member includes a base connectible to the fixing bracket, an elastic frame connected to the base, a fixing portion connected to the elastic frame, a first positioning portion located on the fixing portion, and a supporting board connected to the base, the elastic frame being movable in an elastic deformation direction to have the fixing portion to be interfered with and coupled to the supporting board, and the fixing portion move to a position where the interface card can be unplugged. Therefore, a user can plug and unplug the interface card easily with both hands.

14 Claims, 6 Drawing Sheets

INTERFACE CARD FIXING MEMBER

BACKGROUND OF THE INVENTION

1. Field of the Invention

This invention generally relates to fixing elements, and more specifically, to an interface card fixing member, which is applicable to a fixing bracket that is installed in a mechanical case of an electronic device, for fixing an interface card.

2. Description of Related Art

Generally, an electronic device, such as a mainframe computer or an industry computer, has stand-up adapter cards installed on a motherboard, and a plurality of interface cards plugged into the stand-up adapter cards and therefore being parallel to the motherboard, so as to reduce the size and expand the functionalities of the motherboard. For example, a mainframe computer, such as a network server or an industry server, in order to enhance its functions and cope with its heavy duty workload, has to have varieties of interface cards, such as a sound card, display card, video capture card, graph card, video card, adapter, small computer system interface card, and peripheral component interconnect card, etc.

However, the interface card that parallelly plugged into the stand-up adapter card is easily to get loose if the plugging interference is the only clamping force, therefore a shaking situation brought out by processes of assembly, transportation, and others may cause the interface card of falling out, or getting loose, and may further make the electronic device incapable of operating normally. For this reason, the industry mostly fixes the stand-up adapter card to a fixing bracket, meanwhile, on each of the front and rear ends of the fixing bracket relative to the lateral sides of the interface card, installs a fixing element or a fixing structure to fix the interface cards, as shown in FIGS. 1 and 2.

As shown in FIG. 1, which illustrates a fixing mechanism according to Taiwanese Patent No. M276240, the fixing mechanism comprises structures installed in a mechanical case 10, and a separate fixing element 14. The mechanical case 10 comprises a first board body 101 and a second board body 102. A flange 103 is formed on the first board body 101. A fixing plate 104 is formed on the flange 103. A magazine 1041 is formed on the fixing plate 104. A motherboard 11 having a plurality of sockets 110 is installed on the second board body 102. A plurality of add-on cassettes 12 that correspond to the sockets 110 are installed on the first board body 101. A hooking portion 121 is formed on the outside of the add-on cassettes 12. The sockets 110 are for insertion of interface cards 13. The interface card 13 has a blocking tab 131 installed for blocking the add-on cassettes 12. An axle 141 is formed on one end of the fixing element 14 and is pivotally connected to the mechanical case 10. A fixing portion 142 is formed on the other end of the fixing element 14.

However, the fixing element 14 is coordinately installed in the magazine 1041 by means of the axle 141 in order to pivotally connecting to the mechanical case 10, and in order to have the fixing element 14 press on the add-on cassettes 12 and thus fix the interface cards 13, it must make use of the fixing portion 142 that is located at the other end of the fixing element 14 to couple with the hooking portion 121. Therefore, the constructions of the fixing element 14 and the first board body 101 are complicated and the production cost is high as well.

Referring to FIG. 2, which illustrates an interface card fixing member 20 that is installed on a fixing bracket 30 according to another prior art, the interface card fixing member 20 comprises a coupling portion 201 for coupling to the fixing bracket 30, a fixing portion 203 for fixing an interface card, and an operation portion 205 for releasing the fixing portion 203. While installing the interface card, a user has to pull the operation portion 205 with one hand, and hold and plug the interface card into a socket of a motherboard with the hand; while unplugging the interface card, the user has to pull the operation portion 205 with one hand, and withdraw the interface card from the socket of the motherboard with the other hand.

However, since interface cards are not equal in length. For example, the length of an interface card for a server is approximately equal to the width of a host housing of the server. Therefore, it is not easy for a user to plug the interface card into the socket with only one hand.

Moreover, while plugging a plurality of interface cards into the sockets, user has to manipulate many interface cards at the same time, which requires a great deal of labor force, thus relatively increases the difficulty level in single hand operation. Therefore, this kind of prior art is inconvenient in application.

Hence, it is a highly urgent issue in the industry for how to provide a technique which provides a simple structure that is easy to plug in and unplug interface cards, thus can effectively solve the aforementioned drawbacks of the prior art.

SUMMARY OF THE INVENTION

In views of the aforementioned disadvantages of the prior art, it is a primary objective of the present invention to provide an interface card fixing member that is easy to be installed and uninstalled.

It is another objective of the present invention to provide an interface card fixing member having a simple structure.

It is a further objective of the present invention to provide an interface card fixing member that has design flexibility.

To achieve the aforementioned and other objectives, an interface card fixing member is provided according to the present invention. The interface card fixing member is applicable to a fixing bracket of an electronic device, for fixing an interface card.

In a preferred embodiment, the interface card fixing member includes a base connectible to the fixing bracket, an elastic frame having a first end connected to the base and a second end opposing to the first end, a fixing portion connected to the second end of the elastic frame for fixing the interface card, a supporting board connected to the base, a first positioning portion located on the fixing portion, and a second positioning portion located on the supporting board for selectively correspondingly positioning to the first positioning portion by means of the elastic deformation of the elastic frame.

According to another embodiment of the present invention, the interface card fixing member comprises a base connectible to the fixing bracket; a plurality of elastic frames, each of which has a first end connected to the base, and a second end opposing to the first end; a plurality of fixing portions connected to the second ends respectively, for fixing a plurality of interface cards; a plurality of supporting boards connected to the base, a plurality of first positioning portions located either on the elastic frames or on the fixing portions; and a plurality of second positioning portions located on the supporting board respectively. Each the fixing portion can independently interferingly couple to the second positioning portion by means of elastic deformation of the elastic frame, and further have the fixing portion move to a position to have one of the corresponding interface card be able to be unplugged respectively, meanwhile the other interface cards cannot be unplugged.

Moreover, in the aforementioned two embodiments, the base can selectively install a coupling portion for coupling with the fixing bracket. Better the fixing portion is in an L shape. In a better embodiment, the first positioning portion is a hook on the fixing portion and it functions as the blocker that interferes with the second positioning portion. The supporting board comprises a first ridge for enhancing the strength of the supporting board and an extension portion for accommodating the second positioning portion, wherein, the first ridge is located and protrusive on the side of the supporting board longitudinally, and the extension portion extends from the end of the supporting board opposing to the base.

Compared with the prior art, the design according to the present invention includes the first and second positioning portions that can be positioned first in the processes of installing and uninstalling of an interface card, thus allows the user to plug in and unplug the interface card with both hands, not only allows to steadily install and uninstall the interface card, and based on the basic purpose of simplifying the processes of installing and uninstalling, it further simplifies the complicated applied structure of the prior art. Therefore, the applied design of the present invention has overcome the drawbacks of the complicated structure and the single hand only operation of the prior art, and also provides with easy installing and uninstalling of simple structure; meanwhile, the design of present invention can be modified based on demand, therefore the interface card fixing member provided by the present invention provides has design flexibility. Accordingly, the present invention has overcome the existing drawbacks of the prior art.

BRIEF DESCRIPTION OF DRAWINGS

The present invention can be more fully understood by reading the following detailed description of the preferred embodiments, with reference made to the accompanying drawings, wherein.

DETAILED DESCRIPTION OF PREFERRED EMBODIMENTS

The following illustrative embodiments are provided to illustrate the disclosure of the present invention, these and other advantages and effects can be apparently understood by those in the art after reading the disclosure of this specification. The present invention can also be performed or applied by other different embodiments. The details of the specification may be on the basis of different points and applications, and numerous modifications and variations can be devised without departing from the spirit of the present invention.

Moreover, in the following embodiments, the illustrated description of the interface card fixing member is based on the application example in a server, therefore, any electronic device that needs a fixing bracket for fixing socket extension cards and interface cards falls within the application scope of the present invention, the application of the present invention is not absolutely restricted to the described purpose as applied to the server in the embodiments, it should be noted as aforesaid.

Figure 1:
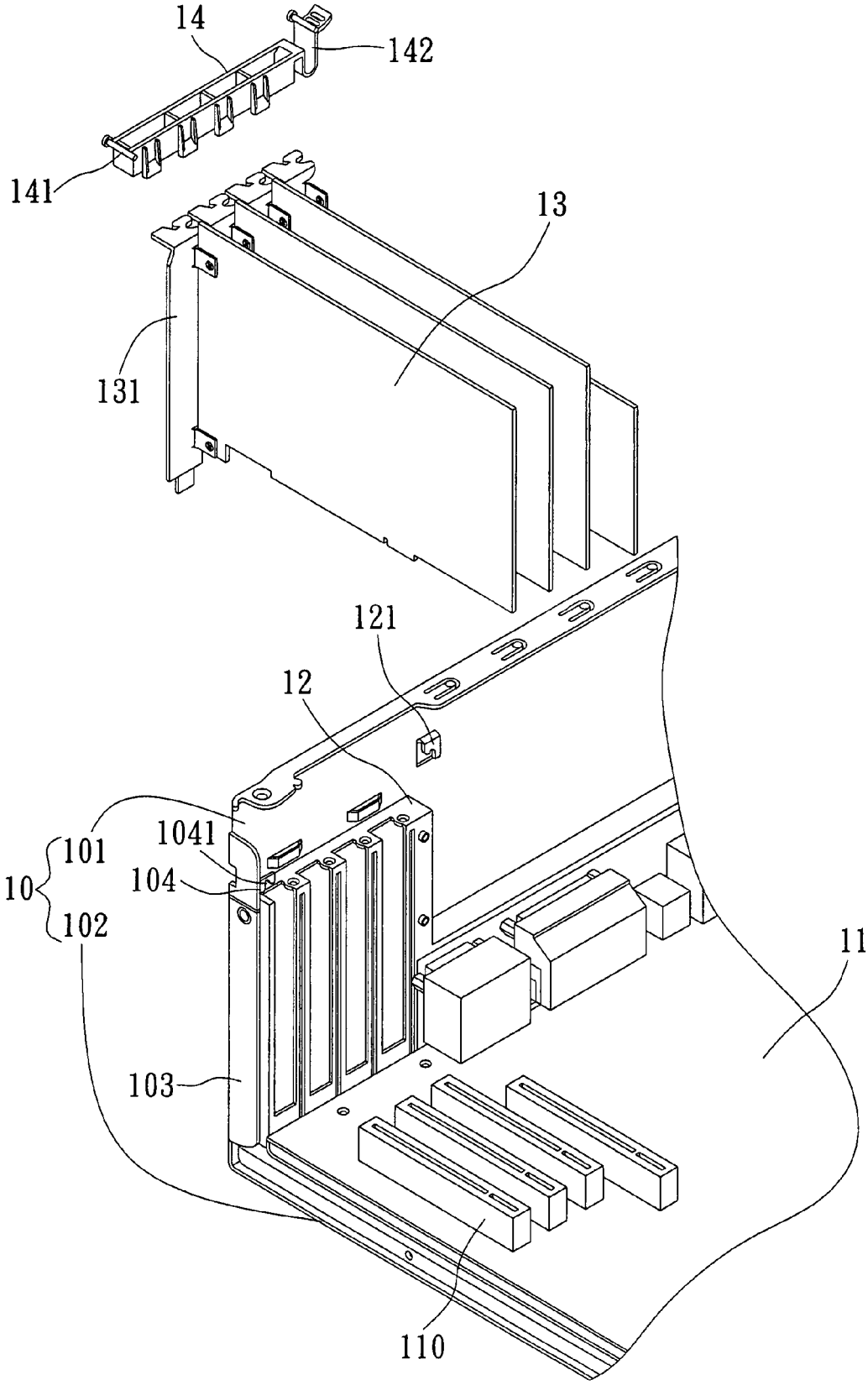
FIG. 1 (PRIOR ART)
FIG. 1 is a schematic diagram of an interface card fixing member according to the prior art.
Figure 2:
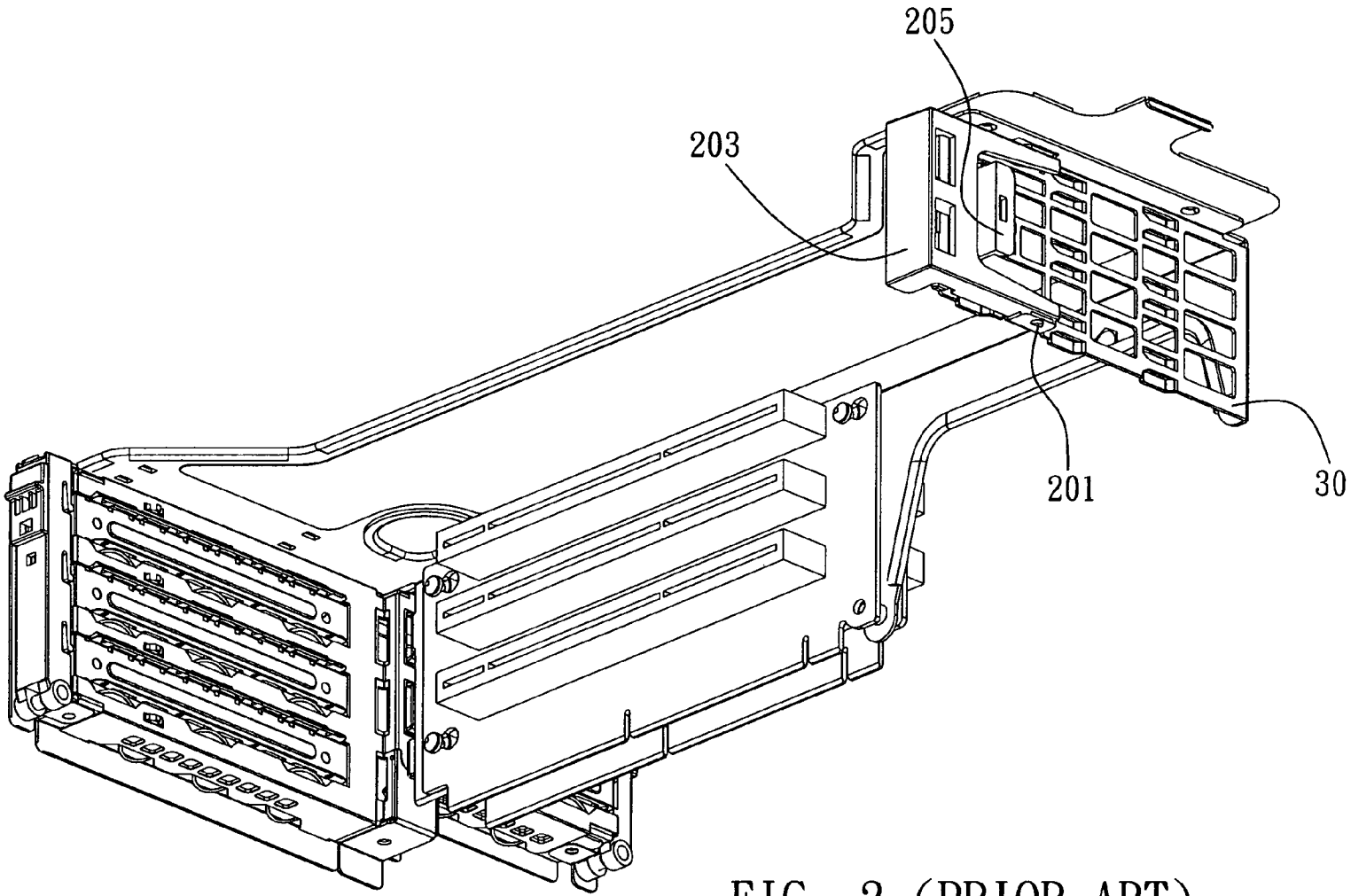
FIG. 2 (PRIOR ART)
FIG. 2 is a schematic diagram of another interface card fixing member according to the prior art.
Figure 3A:
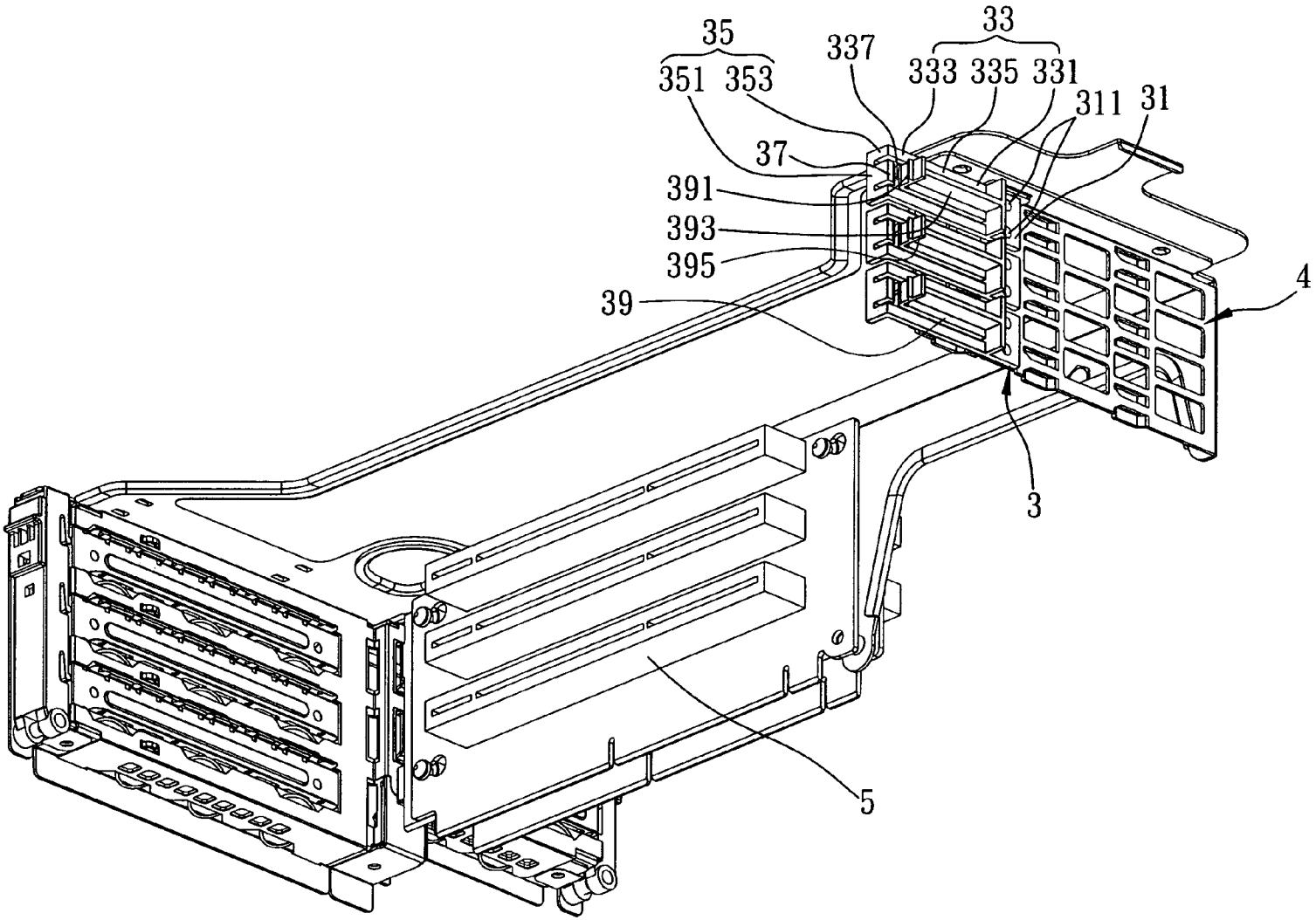
FIG. 3A is a schematic diagram of a fixing bracket installed with an interface card fixing member of a first embodiment according to the present invention.

As shown in FIG. 3A, which is a schematic diagram of a fixing bracket 4 and an interface card fixing member 3 of a first embodiment according to the present invention. The interface card fixing member 3 is applicable to the fixing bracket 4, which is installed in an electronic device, for fixing an interface card at an edge thereof. The interface card fixing member 3 comprises a base 31 for fixing to the fixing bracket 4, an elastic frame 33 connected to the base 31, a fixing portion 35 connected to the elastic frame 33 for fixing the interface card, a first positioning portion 37 installed on the fixing portion 35, and a supporting board 39 connected to the base 31.

A coupling portion having two coupling holes 311 is selectively installed on the base 31. The base 31 can be fixed to the fixing bracket 4 by the coupling portion together with two screws. It should be noted that the installation location, quantity, and coupling mode of the coupling holes 311 are not restricted by the illustrated description in the present embodiment. Moreover, any prior art can be applied to fix the base 31 to the fixing bracket 4, and since this is not the feature of the present invention, there is no need of detailed description herein.

According to the first embodiment, the elastic frame 33 is composed of two connection arms 335 connected to the base 31 at a first end 331 and connected to the fixing portion 35 at a second end 333 respectively. Hence, a receiving space 337 is formed between the elastic frame 33, the base 31 and the fixing portion 35, for receiving the supporting board 39. The width of the fixing portion 35, namely the width of the elastic frame 33, is greater than the thickness of the interface card, but this is not limiting the scope of the present invention.

The fixing portion 35 has a connecting portion 353 connected to the second end 333 of the elastic frame 33, and a blocking portion 351 for fixing the edge of the interface card. According to the first embodiment, the blocking portion 351 of the fixing portion 35 is approximately perpendicular to the connecting portion 353, and the fixing portion 35 is in an L shape. However, the shape of the blocking portion 351 and the angle between the blocking portion 351 and the connecting portion 353 can be modified by those in the art, any modification that can fix the edge of the interface card IC board falls within the scope of the present invention.

Figure 3B:
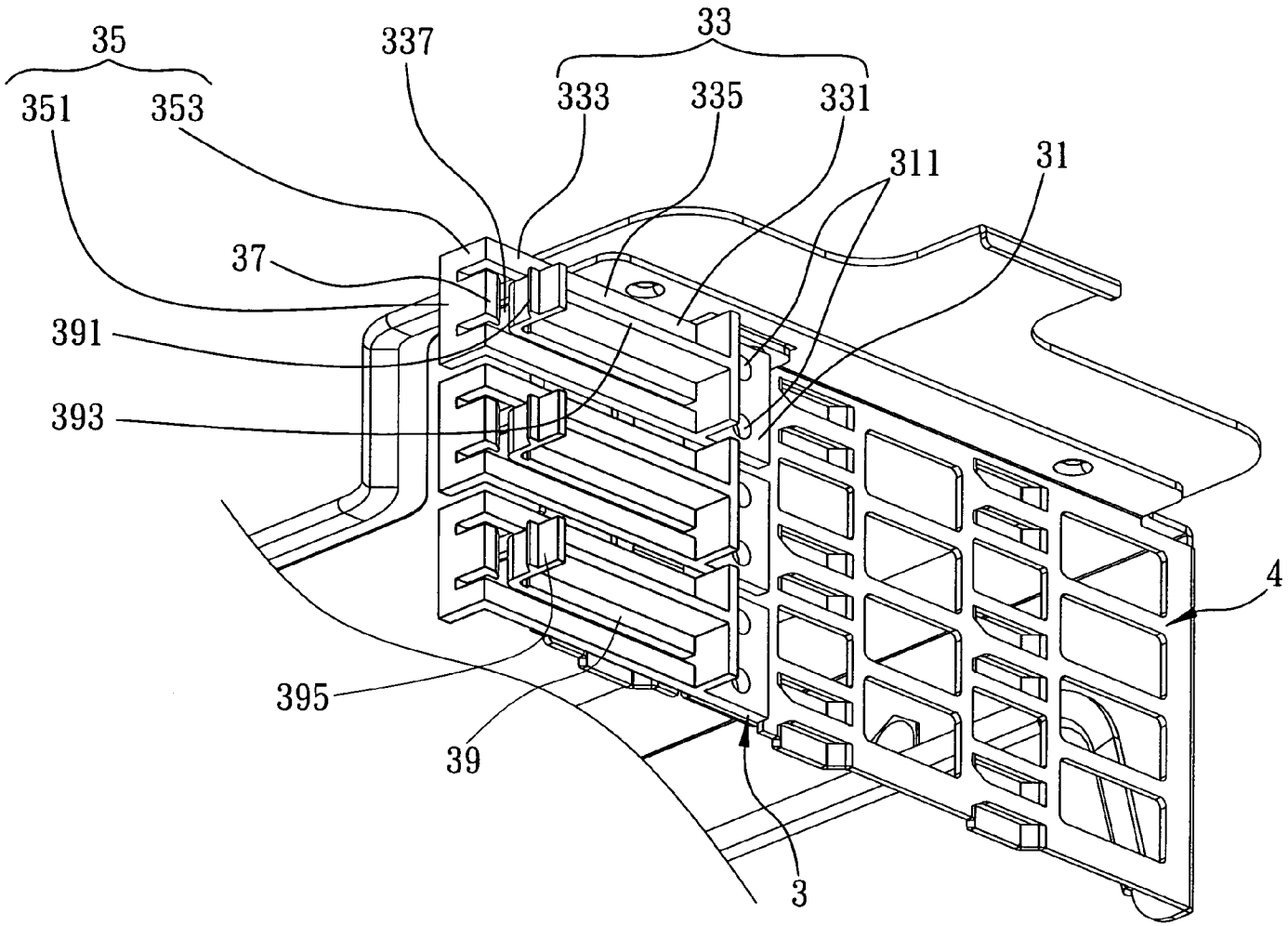
FIG. 3B is an enlarged view of the interface card fixing member shown in FIG. 3A.
Figure 4:
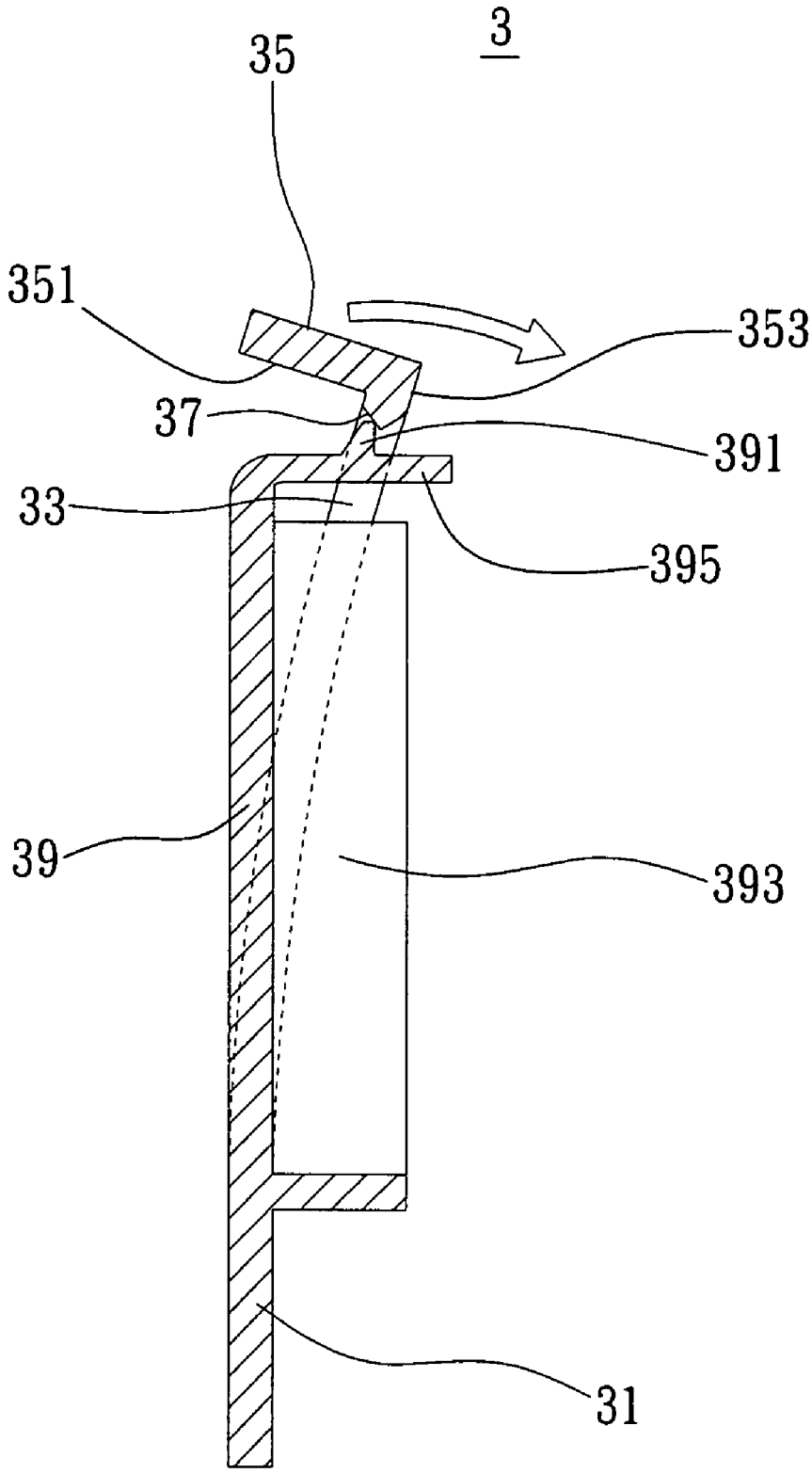
FIG. 4 is a side view of the interface card fixing member shown in FIG. 3A.

The first positioning portion 37 is located on the fixing portion 35 nearby the second end 333 of the elastic frame 33. According to the first embodiment, the first positioning portion 37 has a hook structure. As shown in FIGS. 3 and 4, the first positioning portion 37 is a hook connected to the fixing portion 35 and extending toward the supporting board 39, and is used as a blocker for interfering with the supporting board 39. Of course, in other embodiments, the first positioning portion 37 can also be other equivalent structure that is capable of correspondingly interfering with the supporting board 39.

The supporting board 39 is connected to the base 31, and can be interfered with and fixed to the first positioning portion 37 by the elastic frame 33 if deformed. Accordingly, the blocking portion 351 of the fixing portion 35 moves to a position where the interface card is allowed to be unplugged. According to the first embodiment, the supporting board 39 has a first ridge 393 and an extension portion 395. The first ridge 393 is located and protrusive on the side of the supporting board 39 longitudinally, for enhancing the strength of the supporting board 39. The extension portion 395 extends from the supporting board 39, and a second positioning portion 391 is installed on the extension portion 395 toward the elastic deformation direction of the elastic frame 33, for interfering and coupling with the first positioning portion 37 in the deformation direction of the elastic frame 33. Therefore, the fixing portion 35 is capable of interfering with and being fixed to the second positioning portion 391.

The second positioning portion 391 correspondingly couples to the first positioning portion 37, and the sizes and shapes of both of them can be variable. For example, the second positioning portion 391 can be continuous or broken raised dots, bumps, grooves or any other equivalent structure that is capable of correspondingly coupling with the first positioning portion 37, and the first positioning portion 37 can be any corresponding structure in addition to hook. Since the aforementioned variations can be understood and applied accordingly by those in the field, there is no need of detailed description with illustration herein.

To fix an interface card, as shown in FIG. 4, a user may first pull the fixing portion 35 in a direction (indicated by an arrow) toward the second positioning portion 391, to have the first positioning portion 37 be coupled to the second positioning portion 391 of the supporting board 39. At this moment, since the first positioning portion 37 is interfered with and fixed to the supporting board 39, the user can hold and fix the interface card with both hands. After plugging the interface card into the socket, the user can press the second positioning portion 391 to have the supporting board 39 and the first positioning portion 37 be separated from each other. Thus, the fixing portion 35 goes back to its original position and then fixes the interface card.

Similarly, to withdraw the interface card, first pull the fixing portion 35 toward the second positioning portion 391 to have the first positioning portion 37 couple to the second positioning portion 391, the user can use both hands to hold the interface card for uninstalling. After uninstalling the interface card, the user further presses down the second positioning portion 391 to have the supporting board 39 and the first positioning portion 37 uncoupling from each other, thus the fixing portion 35 goes back to its original position.

Compared with the prior art, the interface card fixing member 3 according to the present invention is capable of selectively designing the corresponding positions of the first positioning portion 37 and the supporting board 39, the user can easily install and uninstall the interface card with both hands. Meanwhile, the present invention has no need of installing a complicated corresponding structure in the mechanical case or in the fixing element itself, and is relatively capable of simplifying the unity of the fixing element structure, and thus provides an interface card of simple structure. In view of the aforementioned advantageous features, the present invention has overcome the drawbacks and inconvenience of the prior art.

Moreover, the illustrated description of the present embodiment is based on the example of one interface card, the present invention is also capable of forming an unity of a plurality of successive interface card fixing members for fixing a plurality of interface cards, and in this kind of embodiment, a base can be shared by the plurality of interface card fixing members, and since this kind of variation can be understood and applied accordingly by those in the field, there is no need of detailed description with illustration herein.

Figure 5:
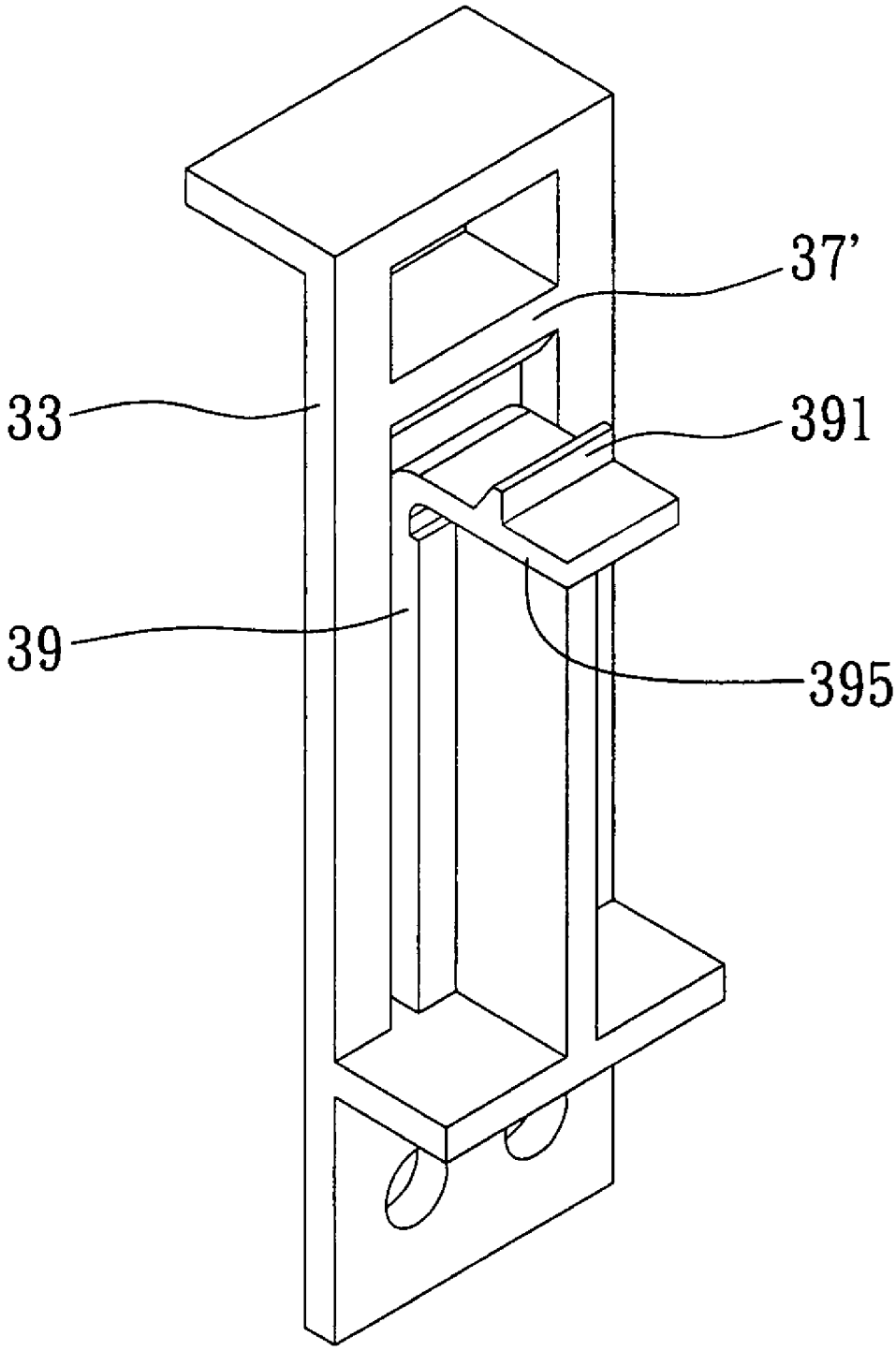
FIG. 5 is a schematic diagram of an interface card fixing member of a second embodiment according to the present invention.

Furthermore, according to the applications that have similar technique spirit as the present invention, the first positioning portion can also be located at the connecting portion of the fixing portion 35. As shown in FIG. 5, the first positioning portion 37' is located at the connecting portion, and the first positioning portion 37' can have the blocking structure that is located below a groove corresponding to the first ridge 391 for coupling to the first ridge 391. The length of the fixing portion 35 is shortened from in FIG. 4 to the length that allows the first positioning portion 37' to couple with the first ridge 391. Therefore, the aforementioned modification can also similarly simplify the structure and the processes of installing and uninstalling.

In other words, the present invention is capable of providing a variety of embodiments based on the demand with interface card fixing member that has simple structure and is easy to use for installing and uninstalling interface cards, and no need of using tools for the processes of installing and uninstalling. Therefore, compared with the prior art, the interface card fixing member 3 according to the present invention is capable of selectively designing the corresponding positions of the first positioning portion 37 and the second positioning portion 39, thus not only allows the user to focus on the actions of plugging in/unplugging, but also saves the production cost of the complicated structure of the prior art, and relatively enhances efficiency with the practical design flexibility.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the app ended claims.

What is claimed is:

1. An interface card fixing member applicable to a fixing bracket of an electronic device, for fixing an interface card, the interface card fixing member comprising:

a base connectible to the fixing bracket;

an elastic frame having a first end connected to the base, and a second end opposing to the first end;

a fixing portion connected to the second end of the elastic frame, for fixing the interface card;

a first positioning portion installed on the fixing portion; and a supporting board connected to the base;

wherein the elastic frame is movable in an elastic deformation direction to have the fixing portion be interfered with and coupled to the supporting board, and the fixing portion move to a position where the interface card cab be unplugged.

2. The interface card fixing member of claim 1, wherein the fixing portion comprises a connecting portion connected to the second end of the elastic frame, and a blocking portion for fixing the interface card.

3. The interface card fixing member of claim 2, wherein the first positioning portion is a blocking bump located on the connecting portion.

4. The interface card fixing member of claim 1, wherein the base has a coupling portion for fixing and coupling the interface card fixing member to the fixing bracket.

5. The interface card fixing member of claim 1, wherein the first positioning portion is a hook located on the fixing portion.

6. The interface card fixing member of claim 1, wherein the supporting board comprises a first ridge and an extension portion.

7. The interface card fixing member of claim 6, wherein the first ridge is located and protrusive on a side of the supporting board longitudinally, for enhancing the strength of the supporting board.

8. The interface card fixing member of claim 6, wherein the extension portion is extended from the supporting board.

9. The interface card fixing member of claim 1, wherein the elastic frame is composed of two connection arms connected to the base and the fixing portion respectively.

10. The interface card fixing member of claim 9, wherein the fixing portion is connected to ends of the connection arms.

11. The interface card fixing member of claim 10, wherein a receiving space is formed between the elastic frame and the fixing portion, for receiving the interface card.

12. The interface card fixing member of claim 11, wherein the elastic frames have a width greater than a thickness of the interface card.

13. An interface card fixing member applicable to a fixing bracket of an electronic device, for fixing interface cards, the interface card fixing member comprising:

a base connectible to the fixing bracket;

a plurality of elastic frames, each of which comprises a first end connected to the base, and a second end opposing to the first end;

a plurality of fixing portions connected to the second ends of the elastic frames respectively, for fixing the interface cards;

a plurality of first positioning portions located on fixing portions respectively; and a plurality of supporting boards connected to the base;

wherein each of the elastic frames is movable in an elastic deformation direction to have the fixing portion be interfered with and coupled to the supporting board, and the fixing portion move to a position where the interface card can be unplugged.

14. The interface card fixing member of claim 13, wherein each of the supporting boards comprises a first ridge and an extension portion.

* * * * *